United States Patent [19]

Seifert

[11] 4,247,776

[45] Jan. 27, 1981

[54] X-RAY DIAGNOSTIC GENERATOR WITH AN INVERTER FEEDING THE HIGH VOLTAGE TRANSFORMER

[75] Inventor: Gerd Seifert, Spardorf, Fed. Rep. of Germany

[73] Assignee: Siemens Aktiengesellschaft, Berlin & Munich, Fed. Rep. of Germany

[21] Appl. No.: 15,285

[22] Filed: Feb. 26, 1979

[30] Foreign Application Priority Data

Apr. 12, 1978 [DE] Fed. Rep. of Germany ..... 28158932

[51] Int. Cl.[3] ..... H05G 1/70

[52] U.S. Cl. ..... 250/406; 250/402

[58] Field of Search ..... 250/401, 402, 406, 408, 250/421

[56] References Cited

U.S. PATENT DOCUMENTS

| | | | |
|---|---|---|---|
| 3,125,679 | 3/1964 | Ohdo et al. | 250/402 |
| 3,641,408 | 2/1972 | Fiocca | 250/406 |

*Primary Examiner*—Alfred E. Smith
*Assistant Examiner*—Thomas P. O'Hare
*Attorney, Agent, or Firm*—Hill, Van Santen, Steadman, Chiara & Simpson

[57] ABSTRACT

The output voltage of the inverter is supplied to a high voltage transformer to which an X-ray tube with a rotating anode is connected. The rotating anode motor is likewise fed by the inverter. To this end, the inverter can be selectively operated with a high frequency for feeding the X-ray tube and a low frequency for feeding the rotating anode motor. But it is also possible to supply the inverter output voltage in parallel to the high voltage transformer and to a frequency divider at whose output the rotating anode motor lies.

9 Claims, 3 Drawing Figures

X-RAY DIAGNOSTIC GENERATOR WITH AN INVERTER FEEDING THE HIGH VOLTAGE TRANSFORMER

BACKGROUND OF THE INVENTION

The invention relates to an X-ray diagnostic generator with a power rectifier, an inverter supplied by this, the inverter output voltage being supplied to a high voltage transformer, an X-ray tube with a rotating anode connected to the output of the high voltage transformer and a drive circuit for the rotating anode motor designed as an asynchronous motor.

An X-ray diagnostic generator with an inverter feeding the high voltage transformer is described, for example, in the German Offenlegungsschrift No. 2,443,709. Further, X-ray diagnostic generators with rotating anode X-ray tubes are known in which driving circuits for generating the feed voltage for the rotating anode motor are provided which increase the frequency of the feed voltage with respect to the network frequency to, for example, 150 Hz. A drive circuit of this type generally consists of a power rectifier and an inverter that operates with a frequency corresponding to the desired driving frequency for the rotating anode motor.

SUMMARY OF THE INVENTION

The object of the invention is to design an X-ray diagnostic generator of the type initially cited in such manner that a simple and inexpensive construction of the drive circuit for the rotating anode motor ensues.

This object is inventively achieved in that the rotating anode motor is fed by the inverter. The invention procceds therefrom that the inverter feeding the high voltage transformer is, in principle, also suited for feeding the rotating anode motor, and that, thereefore, the voltage for the rotating anode motor can be derived from the output voltage of the inverter feeding the high voltage transformer. Of course, it must be assured that the feed frequency of the rotating anode motor has the required value.

Details of the invention derive from the subclaims.

In the following, the invention is described in greater detail on the basis of two sample embodiments illustrated in the accompanying sheet of drawings; and other objects, features and advantages will be apparent from this detailed disclosure and from the appended claims.

DETAILED DESCRIPTION

Figure 1:
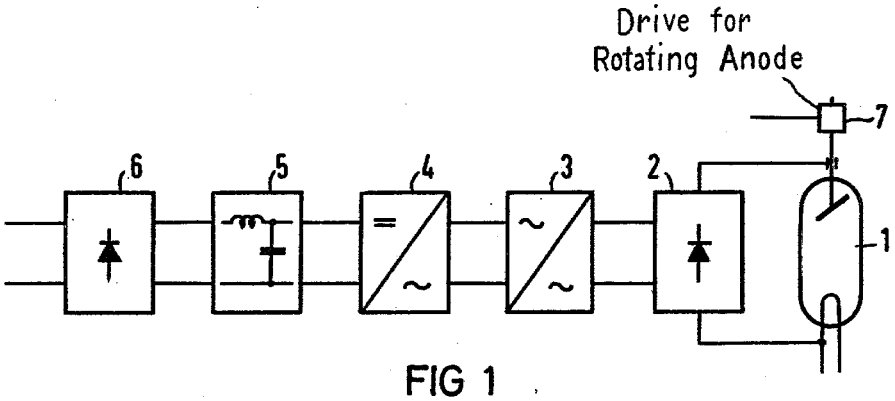
FIG. 1 is a diagrammatic showing of an X-ray diagnostic generator for explaining the idea of the invention.

The X-ray diagnostic generator illustrated in FIG. 1 exhibits an X-ray tube 1 that is connected to the output of a high voltage rectifier 2, which is fed by a high voltage transformer 3. The primary winding of the high voltage transformer 3 is connected to the output of an inverter 4, which is connected to a power rectifier 6 via a constant voltage intermediate circuit 5 (low-pass filter). The feeding of the high voltage transformer 3 and, thus, of the X-ray tube 1 ensues with a frequency in the kHz range increased with respect to the network frequency. Thereby, a small and simple construction of the high voltage transformer 3 is produced. The X-ray tube 1 is a rotating anode X-ray tube, whose anode is driven by means of a rotating anode motor 7 which is an asynchronous motor.

Figure 2:
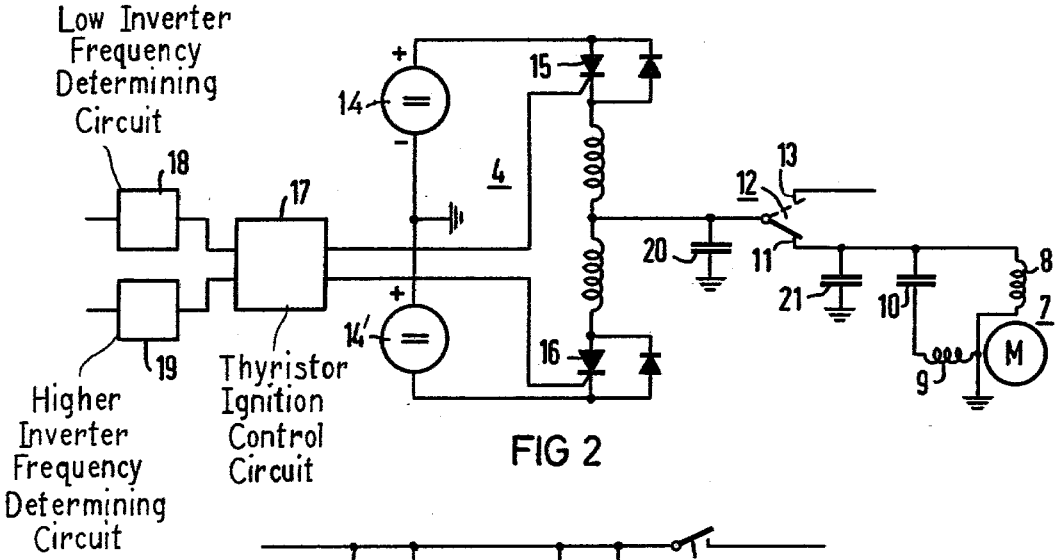
FIG. 2 shows a first embodiment of a drive circuit for the rotating anode motor of an X-ray diagnostic generator according to the invention.

In the drive circuit for the rotating anode motor 7 illustrated in FIG. 2, the main winding 8 of the rotating anode motor 7 is directly connected with the one contact 11 of a changeover switch 12, whereas the auxiliary winding 9 is connected with the contact 11 via a capacitor 10. The other fixed contact 13 of the changeover switch 12 leads to the high voltage transformer 3. The movable contact of the changeover switch 12 is connected to the output of the inverter 4. In the example, the input constant voltage of the inverter 4 is supplied by two constant voltage sources 14 and 14' connected in series, whose connection point is grounded. The inverter 4 exhibits two thyristors 15 and 16, which are alternately ignited by an ignition circuit 17. The ignition circuit can be switched over to either of two inverter frequencies via respective input stages 18 and 19. A capacitor 20 lies parallel to the inverter output and a capacitor 21 lies parallel to the input of the rotating anode motor 7.

For the production of an X-ray photograph in the X-ray diagnostic generator according to FIG. 2, first a low inverter frequency is selected via the input stage 18, which is suitable for feeding the rotating anode motor 7. The changeover switch 12 at first assumes the drawn-in position and the rotating anode motor 7 is driven. Before an X-ray photograph, the oscillatory capacitor 20 is enlarged by means of the capacitor 21. If an X-ray photograph is now to be triggered, then the input stage 19 is selected and the inverter frequency is increased to the value in the KHz range which is provided for feeding the high voltage transformer 3. At the same time, the changeover switch 12 is changed over into the position indicated by the broken line, in which it feeds the high voltage transformer 3 and, thus, the X-ray tube 1. The photograph, therefore, ensues with the running-out rotating anode of the X-ray tube 1. Upon completion of a photograph, the rotating anode motor 7 can be braked by connecting the main winding 8 to the constant current source 14 by means of thyristor 15. After the time required for braking, this braking current can be erased by means of a single-shot ignition of thyristor 16 and self-oscillation via the diode which lies parallel to thyristor 16.

Figure 3:
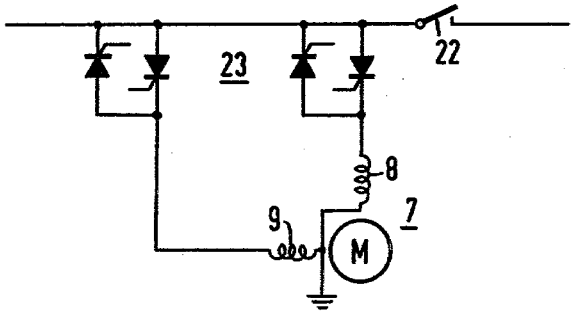
FIG. 3 shows a second embodiment of a drive circuit for the rotating anode motor of an X-ray diagnostic generator according to the invention.

In the sample embodiment according to FIG. 3, the output voltage of the inverter 4 can be supplied to the high voltage transformer 3 via a switch 22 that is closed during an exposure, and can be supplied to the main winding 8 and the auxiliary winding 9 of the rotating anode motor 7 via a thyristor circuit 23. The thyristor circuit 23 connects predetermined half-waves of the output voltage of the inverter 4 through to the main winding 8 and to the auxiliary winding 9 of rotating anode motor 7. By means of a suitable selection of these half-waves, the driving frequency as well as the phase angle between the current in the main winding 8 and in the auxiliary winding 9 as well as the voltage-time area in the main and auxiliary phase can be varied. In this sample embodiment, too, the braking of the rotating anode after an exposure is possible in that the primary winding 8 is applied to a constant current source. To this end, an inverter branch can again be driven with low resistance during the braking time and finally be erased by means of the second branch.

In the sample embodiments, a half-bridge is illustrated as the inverter. Within the framework of the invention, however, other versions of inverters can also be used.

In principle, the thyristor circuit 23 forms a frequency demultiplier, (divider) which feeds the windings 8, 9 of the rotating anode motor 7.

From FIGS. 2 and 3, it ensues that, upon use of the inverter 4 for feeding the rotating anode motor 7, a very simply constructed drive circuit for the rotating anode motor 7 is produced, which, in the example according to FIG. 2, consists only of the component elements 12, 18 and 21 and, in the sample embodiment according to FIG. 3, consists of a thyristor circuit 23 supplemented by a corresponding control logic.

It will be apparent that many modifications and variations may be effected without departing from the scope of the novel concepts and teachings of the present invention.

I claim as my invention:

1. An X-ray diagnostic generator with a high voltage transformer, a power rectifier, an inverter fed by the rectifier, said inverter having its output voltage supplied to the high voltage transformer, an X-ray tube with a rotating anode connected to the output of the high voltage transformer, and a drive circuit for the rotating anode motor designed as an asynchronous motor, characterized in that the rotating anode motor (7) is likewise fed by the inverter (4), control means connected with said inverter whereby the power supplied by the inverter to the anode motor has a frequency suitable for driving said anode motor, means whereby the power supplied by the inverter to said high voltage transformer is in the kilohertz range and is appropriate for driving said high voltage transformer, and means whereby the voltage supplied by the inverter to said anode motor has a magnitude appropriate for operating said anode motor.

2. An X-ray diagnostic generator according to claim 1, characterized in that a frequency divider (23) has its output connected with the rotating anode motor (7), and in that the inverter output voltage can be supplied in parallel to the high voltage transformer (3) and to the frequency divider (23).

3. An X-ray diagnostic generator according to claim 2, characterized in that the frequency divider (23) is formed by a circuit arrangement which connects predetermined half-waves of the output voltage of the inverter (4) through to the windings (8, 9) of the rotating anode motor (7).

4. An X-ray diagnostic generator with a high voltage transformer, a power rectifier, an inverter fed by the rectifier, said inverter having its output voltage supplied to the high voltage transformer, an X-ray tube with a rotating anode connected to the output of the high voltage transformer, and a drive circuit for the rotating anode motor designed as an asynchronous motor, characterized in that the rotating anode motor (7) is likewise fed by the inverter (4), and further characterized in that a control circuit (17, 18, 19) is present for the inverter (4), by means of which the inverter (4) can be selectively operated with a first relatively high frequency for feeding the X-ray tube (1) and a second relatively low frequency which is lower than said first frequency for feeding the rotating anode motor (7), and in that switchover means (12) for the selective connection of the inverter output with the high voltage transformer (3) and with the rotating anode motor (7) are provided.

5. An X-ray diagnostic generator according to claim 4 with control means connected with said inverter whereby the power supplied by the inverter to the anode motor has said second relatively low frequency which second relatively low frequency is suitable for driving said anode motor, means whereby power of said first relatively high frequency is supplied by the inverter to said high voltage transformer and is in the kilohertz range and is appropriate for driving said high voltage transformer, and means whereby the voltage of the second relatively low frequency supplied by the inverter to said anode motor has a magnitude appropriate for operating said anode motor.

6. An X-ray diagnostic generator with a high voltage transformer, power supply means, an inverter fed by the power supply means, said inverter having means for connecting the output of the inverter to the high voltage transformer, an X-ray tube with a rotating anode connected to the output of the high voltage transformer, and a rotating anode motor for driving said rotating anode, said rotating anode motor having means for connecting the output of said inverter (4) therewith, control means comprising a control circuit (17, 18, 19) connected with said inverter (4) for selectively operating said inverter with a first relatively high frequency for feeding the X-ray tube (1) and with a second relatively low frequency which is lower than said first frequency for feeding the rotating anode motor (7).

7. An X-ray diagnostic generator according to claim 6 with said control circuit being selectively operable to control said inverter to supply power of said first relatively high frequency to said high voltage transformer which first relatively high frequency is in the kilohertz range.

8. An X-ray diagnostic generator according to claim 6, with said control means comprising a frequency divider (23) connected between the output of said inverter and said rotating anode motor, and means whereby power from the inverter can be supplied simultaneously to said anode motor via said frequency divider and to said high voltage transformer.

9. An X-ray diagnostic generator according to claim 8 with said frequency divider (23) comprising a circuit arrangement for connecting predetermined half-waves of the output voltage of the inverter to the windings of the rotating anode motor.

* * * * *